US005944228A

United States Patent [19]

Gray

[11] Patent Number: 5,944,228

[45] Date of Patent: Aug. 31, 1999

[54] THERMOPLASTIC CLOSURE FOR A FLUID CONTAINER AND SYSTEM FOR REFILLING A FLUID RESERVOIR

[75] Inventor: Stephen M. Gray, Staten Island, N.Y.

[73] Assignee: Renewable Resources Company, Staten Island, N.Y.

[21] Appl. No.: 08/562,543

[22] Filed: Nov. 20, 1995

Related U.S. Application Data

[63] Continuation of application No. 08/175,074, Dec. 29, 1993, abandoned.

[51] Int. Cl.[6] ..... B65D 55/02; B65D 55/16

[52] U.S. Cl. ..... 222/153.01; 215/216; 222/543; 222/546; 220/375

[58] Field of Search ..... 222/153.01, 425, 222/543, 546; 215/216, 219, 221, 230, 235; 220/254, 375, 357

[56] References Cited

U.S. PATENT DOCUMENTS

| | | | |
|---|---|---|---|
| D. 356,597 | 3/1995 | Gray | D18/56 |
| 3,192,555 | 7/1965 | Nyden | 222/543 |
| 4,090,647 | 5/1978 | Dunning | 222/543 |
| 4,335,823 | 6/1982 | Montgomery et al. | 215/216 |
| 4,558,326 | 12/1985 | Kimura et al. | 347/86 |
| 5,154,325 | 10/1992 | Ryder et al. | 222/212 |
| 5,199,470 | 4/1993 | Goldman | 141/1 |
| 5,213,223 | 5/1993 | Minette | 215/216 |
| 5,261,572 | 11/1993 | Strater | 222/215 |
| 5,329,294 | 7/1994 | Ontawar et al. | 397/87 |
| 5,400,573 | 3/1995 | Crystal et al. | 141/18 |

FOREIGN PATENT DOCUMENTS

| | | |
|---|---|---|
| 29729 | 12/1972 | Australia . |
| 446 079 | 8/1986 | Sweden . |
| 2098969 | 12/1982 | United Kingdom . |

OTHER PUBLICATIONS

EasyFill™ Instruction Manual, 2 pages (1992).
CompuJet™ Instruction Manual, 1 page.
Repeat–O–Type Instruction Manual, 1 page (1992).

*Primary Examiner*—Andres Kashnikow
*Assistant Examiner*—Lisa A. Douglas
*Attorney, Agent, or Firm*—White & Case L.L.P.

[57] ABSTRACT

A thermoplastic closure for a fluid container which has a flexible needle-like dispensing extension continuous with and extending from the base and ending at a tip wherein the extension has an internal cylindrical cavity with an interior aperture positioned within the base and an exterior aperture positioned at the tip. The flexible, needle-like extension facilitates ease in refilling reservoirs such as ink-jet cartridges and facilitates control over the rate of flow of the ink from the container into the reservoir.

5 Claims, 12 Drawing Sheets

THERMOPLASTIC CLOSURE FOR A FLUID CONTAINER AND SYSTEM FOR REFILLING A FLUID RESERVOIR

This application is a continuation of application Ser. No. 08/175,074, filed Dec. 29, 1993, now abandoned.

BACKGROUND OF THE INVENTION

The present invention relates generally to a thermoplastic closure for a fluid container and to a system for refilling a fluid reservoir. A specific embodiment of the invention relates to a system for refilling liquid ink-jet cartridge reservoirs which are used in ink-jet and bubble-jet type printers. The system utilizes an ink-dispensing container having a novel closure which has a needle-like dispensing extension that allows for the safe and effective transfer of ink from the container to the ink-jet cartridge reservoir.

Due to the difficulty in safely and effectively refilling an ink-jet cartridge reservoir, printer users usually discard the cartridge when the ink runs out. This practice is not economical and results in excess waste with ensuing environmental problems. By refilling the cartridge reservoir instead of replacing the cartridge, the user can save money and reduce the amount of waste generated.

Several systems recently have been developed for refilling ink-jet cartridge reservoirs. For the most part, these systems employ a cylindrical ink container attached to a needle-like metal tube. The metal tube is inserted into the ink-jet cartridge reservoir, and the ink is transferred from the container into the reservoir by compressing the container, for example by pushing a plunger into the container, or by holding a sealed container above the cartridge and then puncturing the container to allow the ink to flow into the cartridge reservoir. The metal tube systems used in the prior art are problematic in that they can be dangerous to the user and can accidentally penetrate the skin or puncture other material or equipment.

The ink-jet cartridge refilling systems in the prior art also do not facilitate control over the rate of transfer of the ink from the container to the cartridge reservoir. When the cartridge is filled by compression of a container or by pushing a plunger into the container, the use of excess force can cause the ink to be introduced into the cartridge reservoir at such a rapid rate so that it is not absorbed by the foam containing microporous cells which contain the ink in the cartridge. This can result in an overflow of ink. On the other hand, when the cartridge is refilled by puncturing the seal in the container, the ink flow rate is slower, but there is no effective way of stopping the flow of ink once the cartridge is refilled, thus resulting in unnecessary spilling of ink. This often results in splattering and ineffective refilling of the cartridge.

It is, therefore, desirable to provide an ink-jet cartridge refilling system which is safe, economical, and efficient and which facilitates control over the rate of transfer of the ink from the fluid container to the cartridge reservoir.

SUMMARY OF THE INVENTION

The ink-jet cartridge refilling system of the invention generally comprises an ink-dispensing fluid container with a novel, thermoplastic closure having a flexible, needle-like dispensing extension.

In general, the present invention is used to refill an ink-jet cartridge reservoir by inserting the needle-like dispensing extension through an opening in the cartridge reservoir and then squeezing the container to force ink from the container into the cartridge reservoir.

The closure for the fluid container is injection molded in one piece from a thermoplastic material, such as polypropylene. The closure has a base and a dispensing extension. The base has engagement means for engaging the container and sealing means for creating a seal between the container and the closure when they are engaged.

The dispensing extension is flexible and needle-like in shape and extends from the base of the closure to end at a tip. The dispensing extension has an internal cylindrical cavity of substantially constant diameter with an interior aperture positioned within the base and an exterior aperture positioned at the tip. The closure also includes a tip cover which is removably attached to the tip.

The closure is attached to a dispensing container which has a closed bottom and an open neck which defines an annular opening. The dispensing container contains the fluid ink which is eventually transferred to the ink-jet cartridge reservoir.

The system also comprises means for creating an opening in the cartridge reservoir so that the dispensing extension may be inserted into the reservoir. In certain embodiments, the system may also comprise a refilling station for securing the reservoir as it is being refilled. The refilling station may be constructed of a variety of materials but is preferably constructed of paper and contains a blotter at a suitable position to absorb ink that is released from the cartridge such as when a priming pump is used to equalize the pressure within the cartridge reservoir, as discussed further below.

In a preferred embodiment, a lanyard is optionally attached at one end to the base of the dispensing closure. In this embodiment, the lanyard and closure are made in one piece by injection molding. A tip cover is fixed at the other end of the lanyard, and the lanyard is of sufficient length and flexibility such that the cover may be placed onto the tip of the dispensing closure when it is not in use. A replacement plug may be removably attached at a point on the lanyard and may be used to seal the opening after the reservoir is refilled.

Generally, ink-jet cartridge reservoirs are rectangular in shape and have a cap over the reservoir which contains a microporous foam that stores the ink. Most ink-jet cartridge reservoirs contain an opening in the cap. To refill the reservoir, the dispensing extension is inserted through the opening in the cap into the reservoir. Thereafter, the dispensing container is squeezed to transfer the ink from the dispensing container into the reservoir. The internal design of the closure and extension controls the rate at which the ink is transferred from the container to the reservoir. After the refilling procedure is complete, the dispensing extension is removed from the ink chamber and the tip cover is placed over the tip. The replacement plug, which may be removably attached to the lanyard extending from the base portion of the dispensing closure, is provided to plug the opening after the reservoir is refilled so that ink will not leak from the reservoir. Upon subsequent refills, the replacement plug may be removed and the dispensing extension may be reinserted into the opening to refill the empty reservoir. Thereafter, the replacement plug may again be inserted into the opening to seal the reservoir.

Certain ink-jet cartridge reservoirs and especially multicolored ink-jet cartridge reservoirs, do not contain an opening in the cap over the cartridge. Therefore, the invention also provides a pocket drill which may be used to drill an opening into the cap on the reservoir. The bit of the drill has a diameter that is greater than the diameter of the dispensing extension so that the dispensing extension may be inserted through the drilled opening into the reservoir. The pocket drill optionally includes a safety tip to cover the drill bit when it is not in use. The pocket drill may be turned by hand to cut an ink-well hole in the cap over the reservoir.

For multicolored ink-jet cartridge reservoirs, the present invention also comprises an overcap guide which may be placed on top of the reservoir and used as a drill guide for the pocket drill and as a guide for the dispensing extension so that ink may be transferred into the respective colored ink chambers.

In still other ink-jet cartridges, it is necessary to use an adhesive seal over the release area portion of the ink-jet cartridge. Once the seal is placed over the release area, the ink-jet cartridge is then placed into the refilling station and refilled by inserting the dispensing extension into the ink-jet chamber and squeezing the container to transfer the ink from the container to the reservoir. With most of these types of cartridges, a priming pump is used to introduce air into a vent hole in the cartridge to equalize the pressure within the reservoir. In a specific embodiment, the priming pump must be placed over a vent hole in the ink-jet cartridge after the refilling procedure is complete, and the pump must be depressed once or twice until a small amount of ink bleeds from the release area portion of the cartridge. The priming pump is used to equalize the pressure in the ink chamber and prepare the cartridge for printing.

The priming pump is injection-molded in one piece and is constructed of polypropylene. The pump comprises a cylinder and a piston which fits within the cylinder. The piston has a ring-like portion at one end which has a cross-sectional area that is slightly greater than the cross-sectional area of the cylinder, yet flexible enough that it may frictionally fit within the cylinder. The ring-like portion acts to keep the piston within the cylinder unless an excessive force is used to pull the piston out of the cylinder. A thumb-rest at the top of the piston has a cross-sectional area that is greater than the cylinder and, thus, inhibits the piston from being completely immersed into the cylinder. The thumb-rest is shaped so that a thumb may push on it to push the piston into the cylinder.

The pump is injection molded. Two loops of polypropylene are connected between the thumb-rest at the top of the piston and the top of the cylinder and act as a retraction means to retract the piston out of the cylinder after it is pushed in. As noted above, the ring-like portion prevents the retraction loops from pulling the piston completely out of the cylinder.

An air channel is located along the longitudinal axis of the piston and extends completely through the piston out through the thumb-rest. When a thumb is placed over the thumb-rest of the piston, it covers the air channel so that, as the thumb pushes the piston into the cylinder, air within the cylinder and the channel is pumped into the attached cartridge reservoir. However, when the thumb is removed from the thumb-rest portion, air is free to flow into the cylinder so that as the retraction means pulls the piston out of the cylinder, air is not sucked out of the reservoir.

In a preferred embodiment, the dispensing container and closure are constructed to be tamperproof. In one such embodiment, two plastic lugs are molded into the top of the fluid container on the peripheral section around the neck of the container at positions diametrically opposite to each other. The dispensing closure contains two wings located at diametrically opposite positions along the periphery of the base portion. The position of these wings corresponds to the position of the lugs on the top of the dispensing container. Therefore, when the closure is screwed completely onto the dispensing container, the lugs on the top portion of the bottle lock into the wings. The lugs are designed such that, if someone attempts to unscrew the closure, the lugs will break and cause the top portion of the container to leak. In this way, the container/closure is made tamperproof.

DETAILED DESCRIPTION OF THE PREFERRED EMBODIMENT

Figure 1:
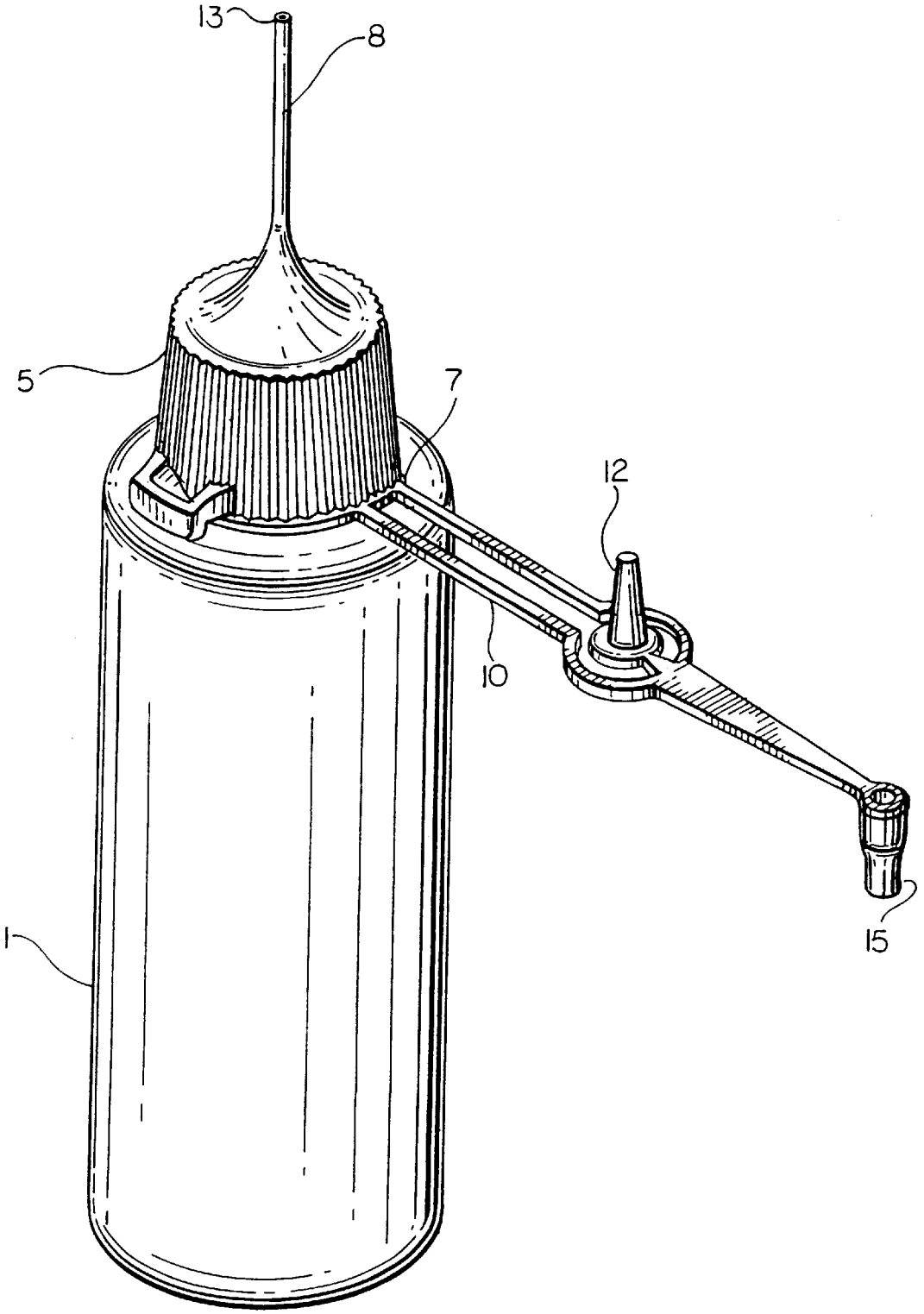
FIG. 1 is a perspective view of a dispensing container engaged to a closure having the cover removed from the tip of the dispensing extension.

Referring to FIG. 1, the invention comprises a dispensing container 1 and closure 5. The closure 5 comprises a flexible needle-like dispensing extension 8 and a lanyard 10 which contains a removably attached replacement plug 12 and a cover 15 that fits over the tip 13 at the end of dispensing extension 8. The lanyard 10 is attached to the dispensing closure 5 at the bottom of the base 7 of the dispensing closure 5.

Figure 2:
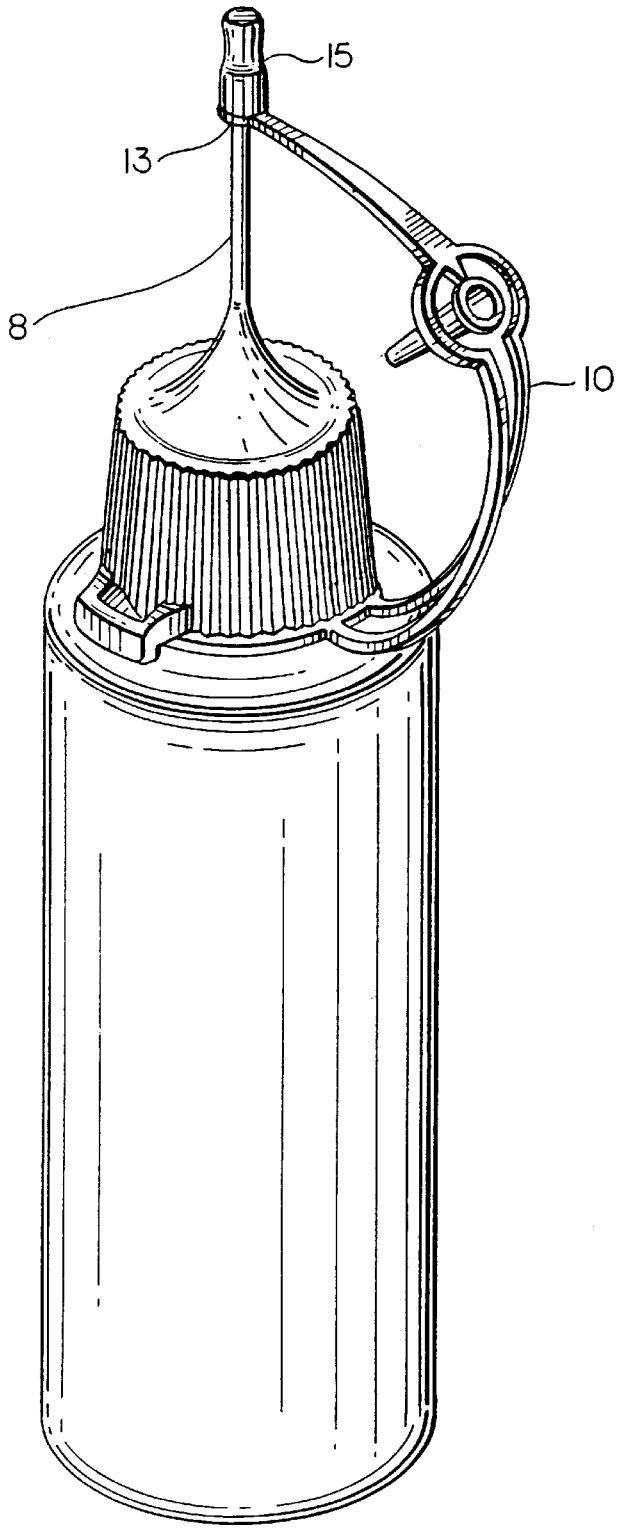
FIG. 2 is a perspective view as in FIG. 1 wherein the cover is placed onto the tip of the dispensing extension.
Figure 3:
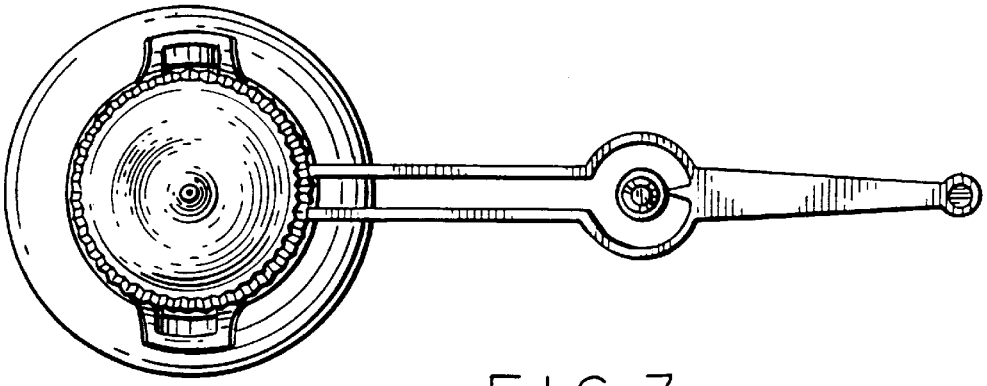
FIG. 3 is a top view of the closure engaged to dispensing container.
Figure 4:
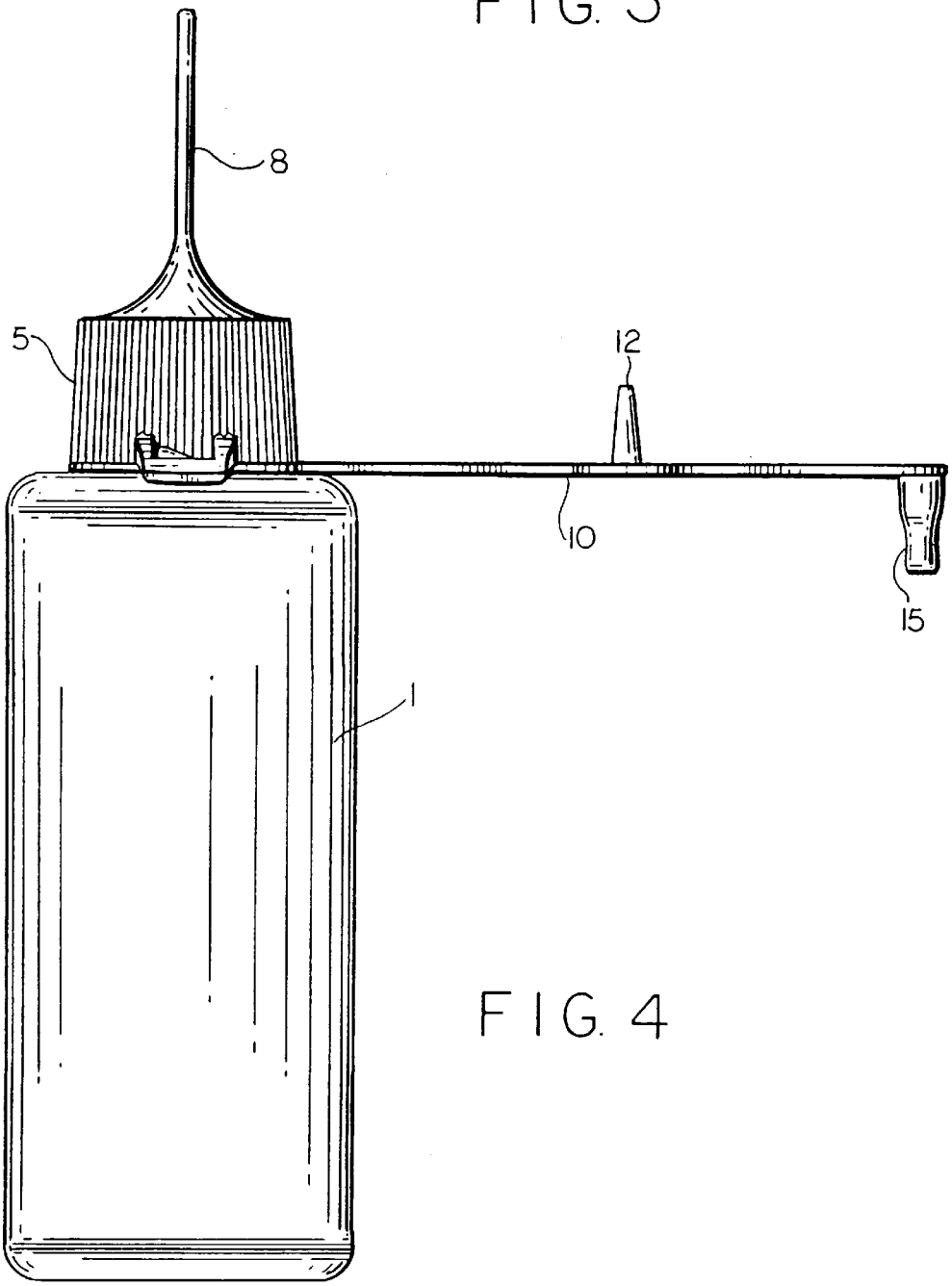
FIG. 4 is a side view of the closure engaged to the dispensing container.

The dispensing container 1 and dispensing closure 5 may be constructed of any suitable thermoplastic, but are preferably made of polypropylene. The container is blow-molded while the cap, tip and all other components are injection-molded. Referring to FIG. 2, the lanyard 10 must be flexible and sufficiently long so that the dispensing-tip cover 15 may be placed onto the tip 13 at the end of the dispensing extension 8 to seal the container 1 when it is not in use.

Figure 5:
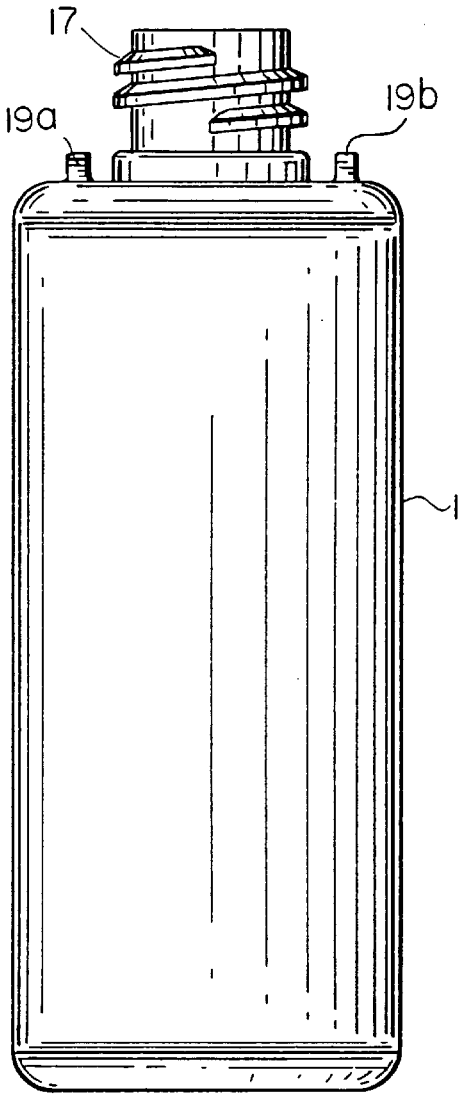
FIG. 5 is a front view of a dispensing container.
Figure 6:
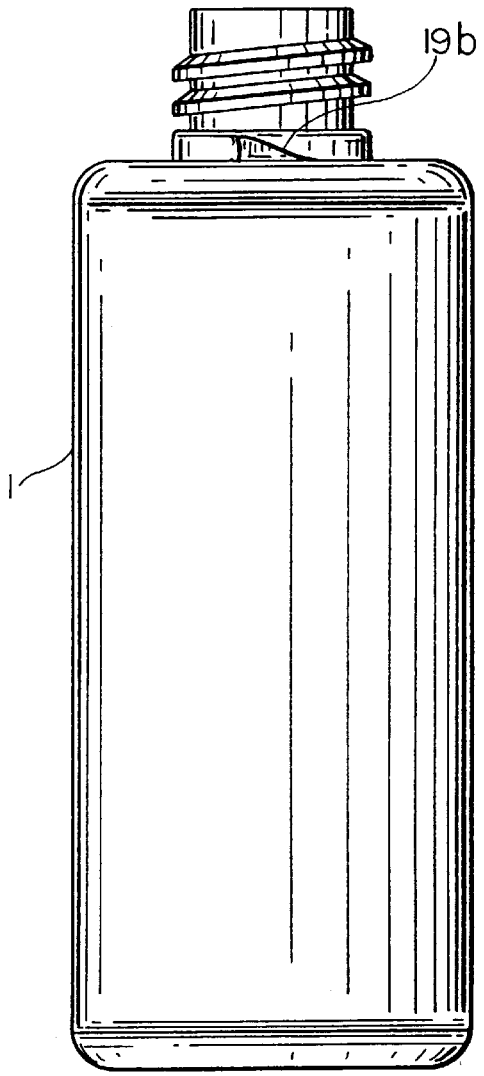
FIG. 6 is a side view of the dispensing container.
Figure 7:
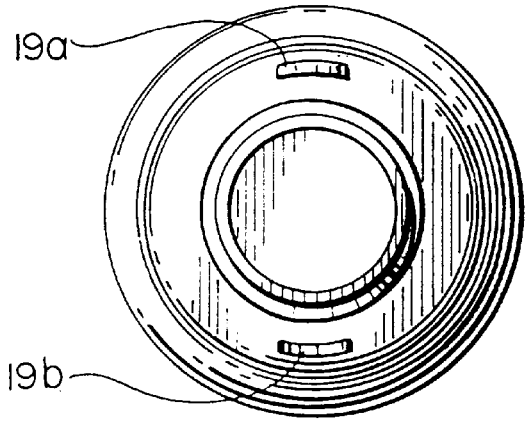
FIG. 7 is a top view of the dispensing container.

Referring to FIGS. 5 and 6, the container 1 has a neck 17 which is externally threaded to receive the closure 5 shown in the other figures. The container 1 also contains two lugs 19*a* and 19*b* at the top of the container. A top view of lugs 19*a* and 19*b* may also be seen by FIG. 7.

Figure 8:
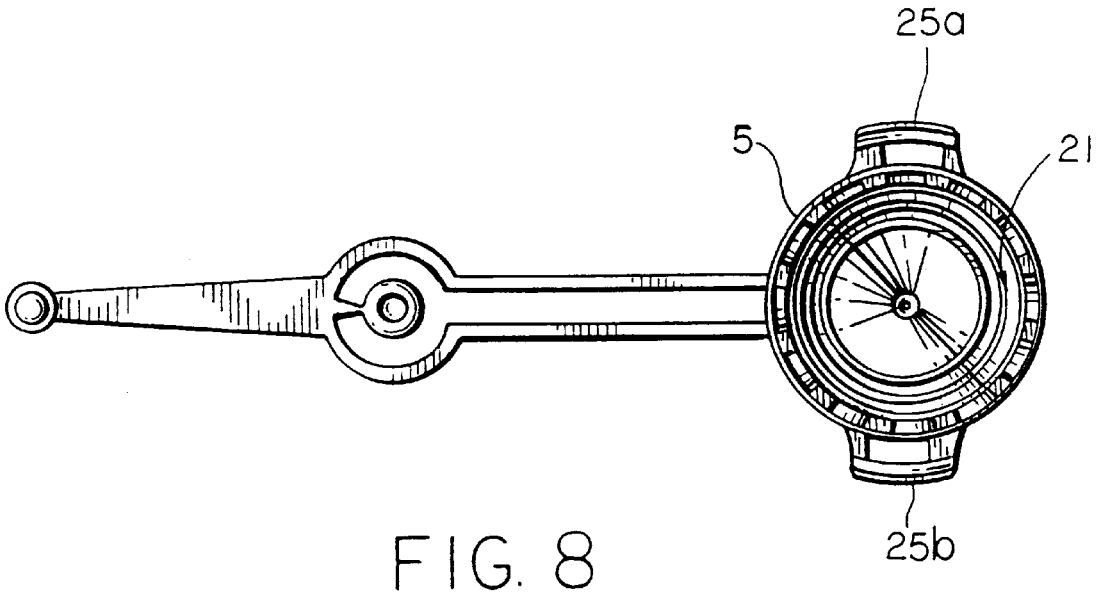
FIG. 8 is a bottom view of the closure, lanyard, replacement plug and tip cover.

FIG. 8 shows a bottom view of closure 5. The closure 5 contains an internally threaded portion 21 which engages the threaded neck 17 of the container 1. Dispensing closure 5 also contains two wings 25*a* and 25*b* which engage lugs 19*a* and 19*b* when the closure 5 is screwed completely onto threaded neck 17 of closure 1.

Referring to a side view of the container 1, as shown in FIG. 6, lugs 19*a* and 19*b* are substantially triangular in shape and are oriented on the container 1 such that wings 25*a* and 25*b* may pass over lugs 19*a* and 19*b* as the closure 5 is screwed onto the threaded neck 17 of container 1. However, when the closure 5 is screwed completely onto neck 17, lugs 19*a* and 19*b* lock into wings 25*a* and 25*b*, and secure the closure 5 to the dispensing container 1 in a manner which creates a tamperproof connection. Lugs 19*a* and 19*b* are triangular in shape such that, if there is an attempt to unscrew the cap 5 from the container 1, they will break and cause the container 1 to leak. In this manner, the container/closure is made tamperproof and is non-resealable.

Figure 9:
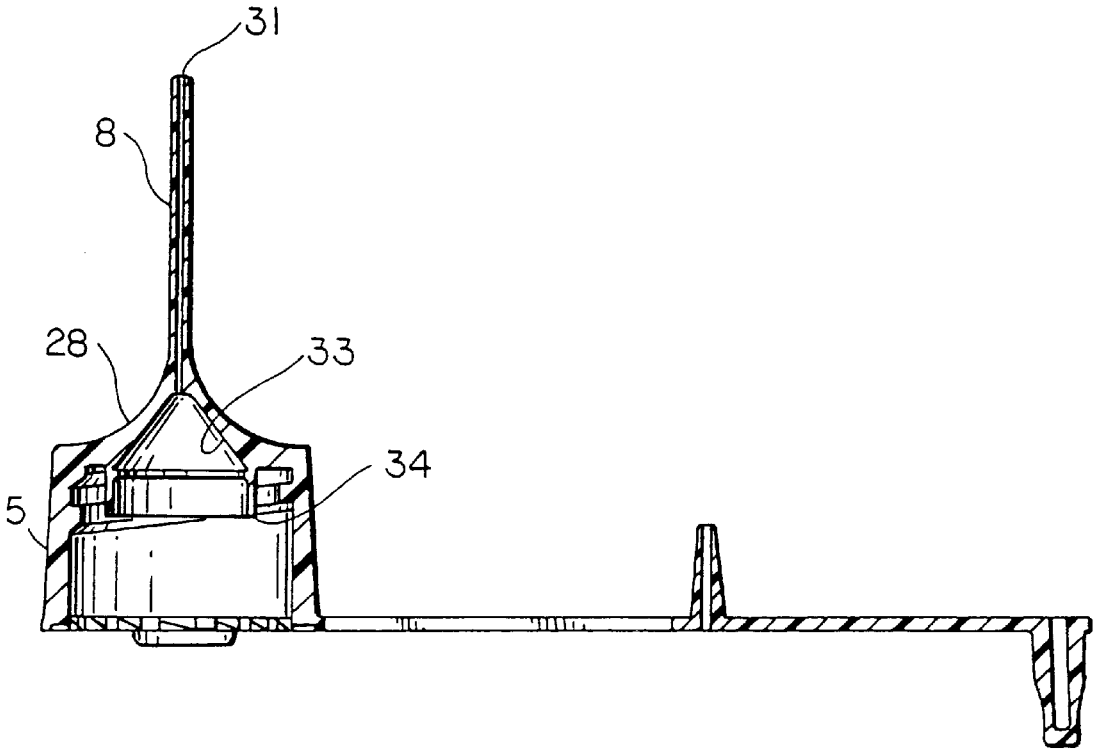
FIG. 9 is a cross-sectional view of the closure lanyard, replacement plug, and tip cover.

FIG. 9 shows a cross-sectional view of the closure 5. The closure 5 is injection-molded and has an external tapered portion 28, which extends into the dispensing extension 8. The dispensing extension 8 is needle-like in shape and contains an internal cylindrical cavity 31 of substantially constant diameter, which communicates with the interior of the dispensing closure 5. The diameter of the internal cavity is approximately 0.022 inches and can vary depending on the intended application. The overall length of the closure as measured from the bottom of the base to the tip at the end of the dispensing extension is about 1 to 3 inches, preferably 1.5 to 2.0 inches. However, the length of the closure and particularly the dispensing extension may vary depending or the application. For instance, the length of the dispensing extension is made longer when the closure is intended to be used for refilling a multicolored cartridge.

The closure 5 also contains a slightly tapered, cylindrical rim 34 which is located within the internal, upper portion of the base. The rim has a bottom, minimum diameter that is less than the diameter of the interior of the neck and an upper, maximum diameter that is greater than the diameter of the neck so that the rim frictionally engages the interior of the neck when the closure is connected to the container to create a seal between the closure and the container.

Figure 12C:
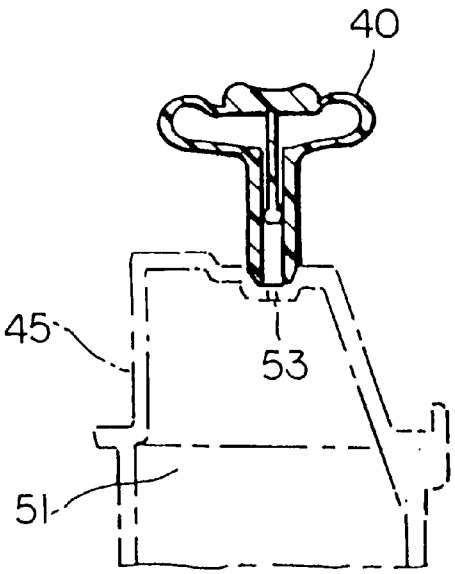
FIG. 12*c* is a side view of the priming pump placed onto the ink-jet cartridge.
Figure 12B:
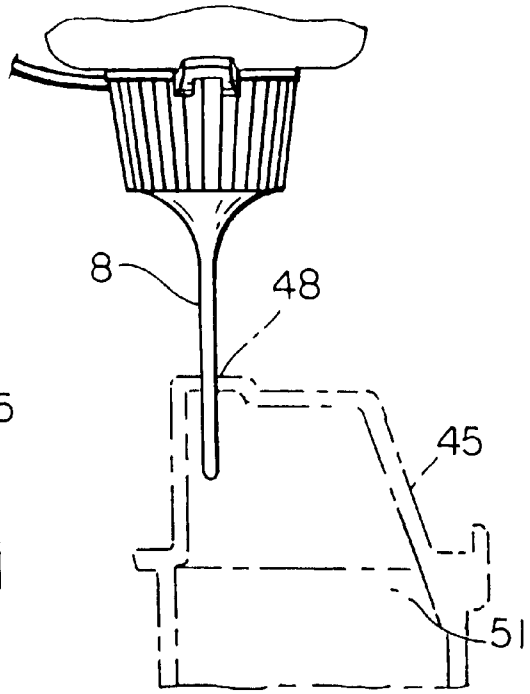
FIG. 12*b* is a side view of the dispensing extension entering the cartridge reservoir.
Figure 17:
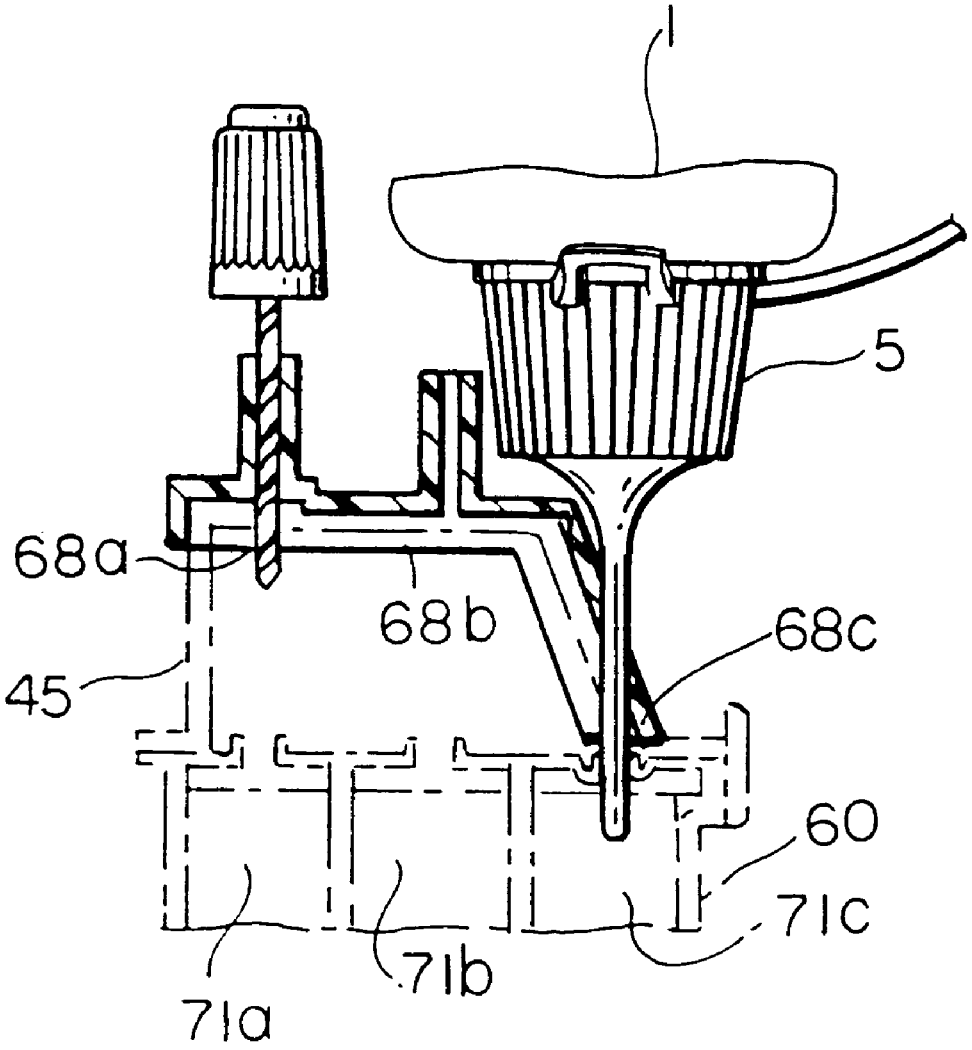
FIG. 17 is a side view of the multicolored overcap guide placed onto a multicolored ink-jet cartridge, with the pocket drill shown inserted into the guide and the dispensing extension shown inserted into the guide.

When closure 5 is screwed onto dispensing container 1 and the dispensing extension 8 is placed into an ink-jet cartridge reservoir (as shown in FIGS. 12B or 17), the internal cavity 31 acts as a fluid connection between the dispensing container 1 and the ink-jet cartridge reservoir which needs to be refilled. The exterior tapered portion 28 of the dispensing closure is a gradual and continuous taper. The closure has an interior tapered section 33 which is tapered conically and ends abruptly when it is at a diameter equal the diameter of internal cylindrical cavity 31 of dispensing extension 8.

Figure 10:
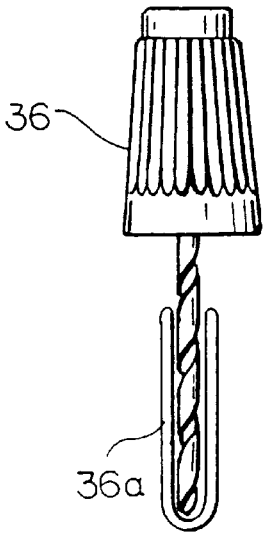
FIG. 10 is a side view of a pocket drill.
Figure 11B:
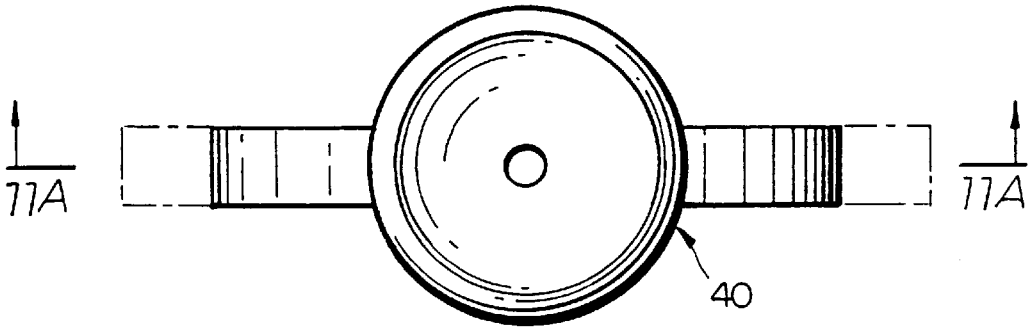
FIG. 11*b* is a top view of the priming plump.
Figure 11A:
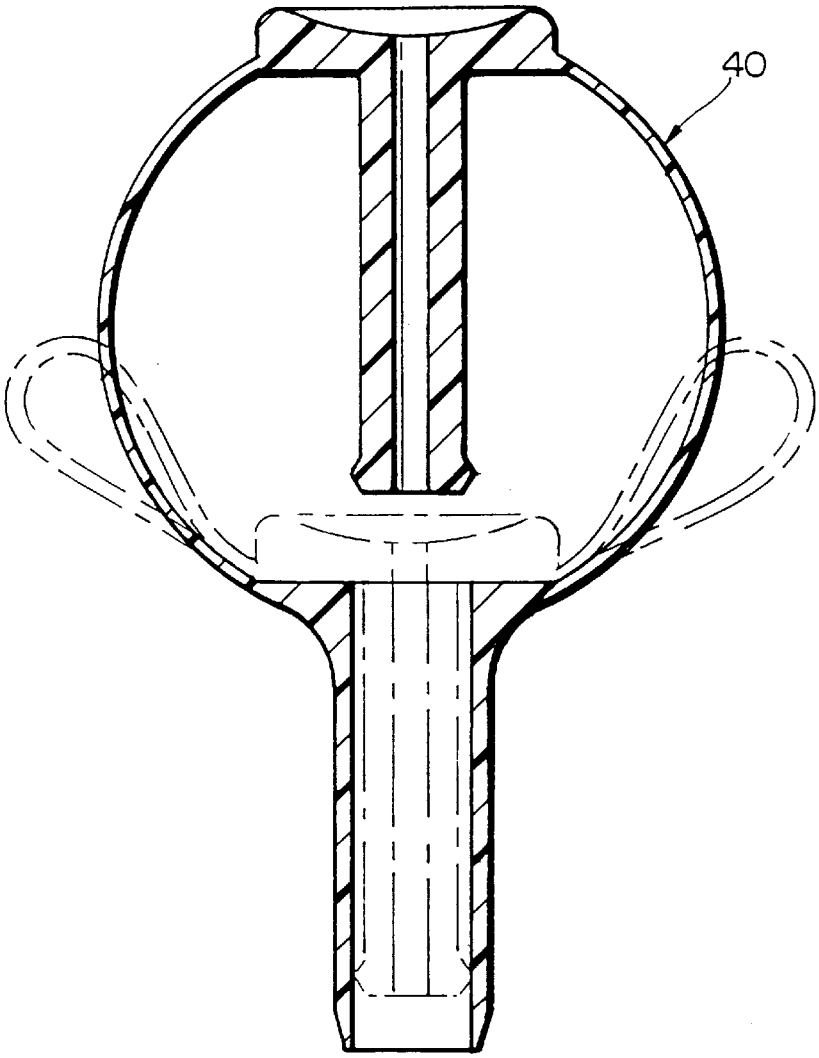
FIG. 11*a* is a side view of a priming pump.

FIG. 10 shows a side view of a pocket drill 36. FIGS. 11*a* and 11*b* show a side view and top view, respectively, of the priming pump 40. Pocket drill 36 may optionally include a pocket drill blade cover, which is not shown in the figures.

Figure 12A:
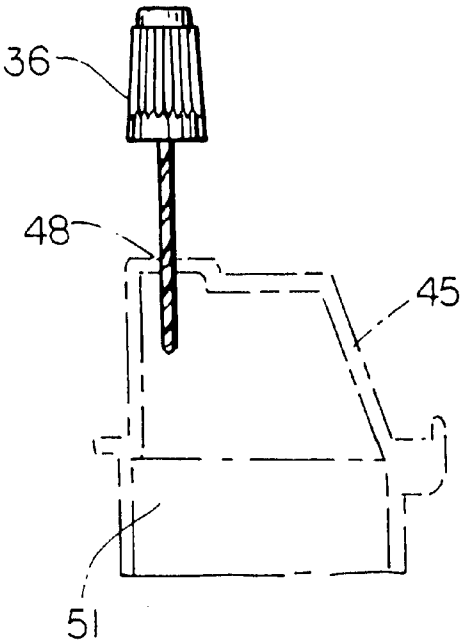
FIG. 12*a* is a side view of the pocket drill cutting into an cartridge reservoir.

FIGS. 12*a*, 12*b* and 12*c* show three steps involved if the pocket drill 36 or priming pump 40 is required to refill a cartridge 45. Referring to FIG. 12*a*, when the cartridge 45 does not contain an opening, the pocket drill 36 is used to create an opening 48 into which dispensing extension 8 may be inserted. Once the pocket drill 36 is used to create opening 48, the dispensing extension 8 is inserted through opening 48 and into reservoir 51 of cartridge 45 and the dispensing container 1 is squeezed gently to transfer the ink from the dispensing container 1 into the reservoir 51. This step is shown in FIG. 12*b*. After the reservoir 51 is completely refilled with ink from the dispensing container 1, a replacement plug 12 is placed into the opening 48. The replacement plug 12 may be removably attached to the lanyard 10 (see FIG. 1).

In certain cartridges, which require equalization of pressure before printing, a priming pump 40 is placed onto a vent 53 of the cartridge and is depressed once or twice to equalize the pressure within cartridge reservoir 51. FIG. 12*c* shows this step and shows where the priming pump 40 is attached to cartridge 45 at the vent 53.

Figure 13:
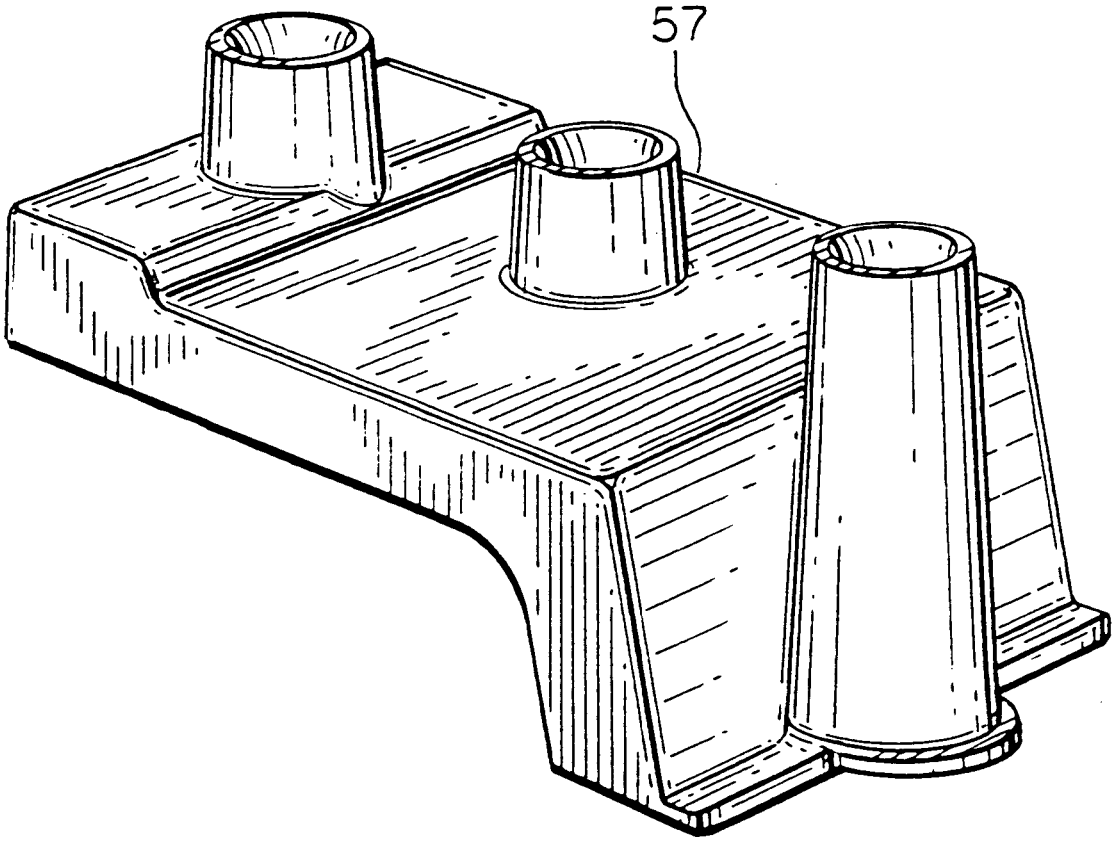
FIG. 13 is a perspective view of an overcap drill guide used for multicolored cartridges.
Figure 14:
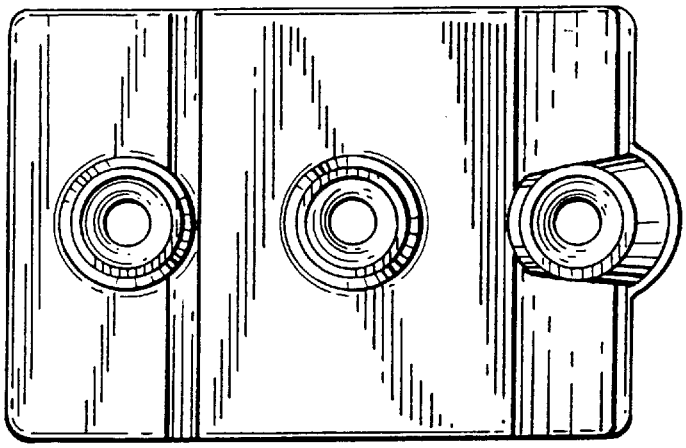
FIG. 14 is a top view of the guide.
Figure 15:
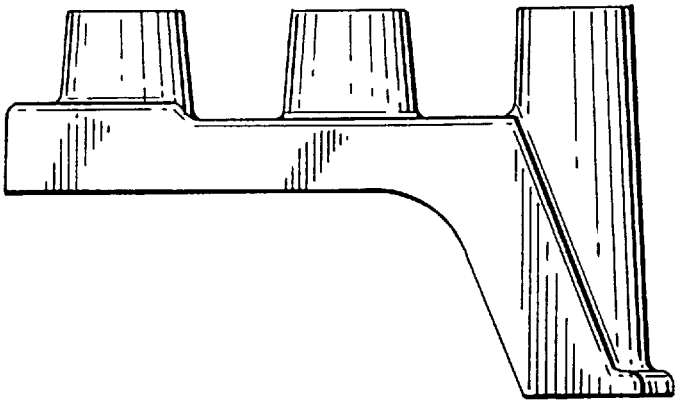
FIG. 15 is a side view of the guide.
Figure 16:
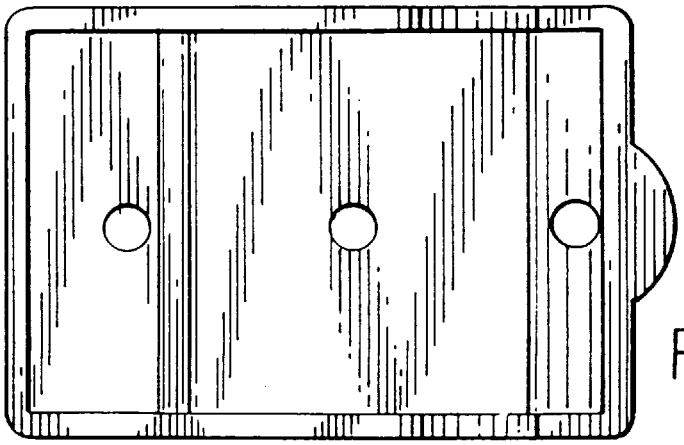
FIG. 16 is a bottom view of the guide.

FIG. 13 shows a perspective view of the overcap guide 57, which is used when refilling a multicolored ink jet cartridge 60, such as that shown in FIG. 17.

As can be seen in FIG. 17, the overcap guide 57 is placed on top of the multicolored cartridge 60 and is used to guide both the pocket drill 36 and the dispensing extension 8. The overcap 57 is configured and dimensioned for each specific cartridge so that it fits tightly over the top of the cartridge.

In operation, the overcap guide 57 is first placed on top of the multicolored cartridge 60, and the pocket drill is then used to create an opening 68*a*, 68*b* and 68*c* in the top of the cartridge 60 for each respective color. Thereafter, a container 1 with closure 5 and dispensing extension 8, containing the appropriate colored ink, is inserted through the guide, through the opening 68*a*, 68*b* or 68*c* and into the respective ink reservoir 71*a*, 71*b* or 71*c*. After each multicolored ink reservoir 71*a*, 71*b*, 71*c* is refilled, the overcap guide 57 is removed from the multicolored cartridge 60 and a replacement plug 12 is inserted into each drilled opening 68*a*, 68*b* and 68*c*. The multicolored cartridge is then ready for use.

Figure 18:
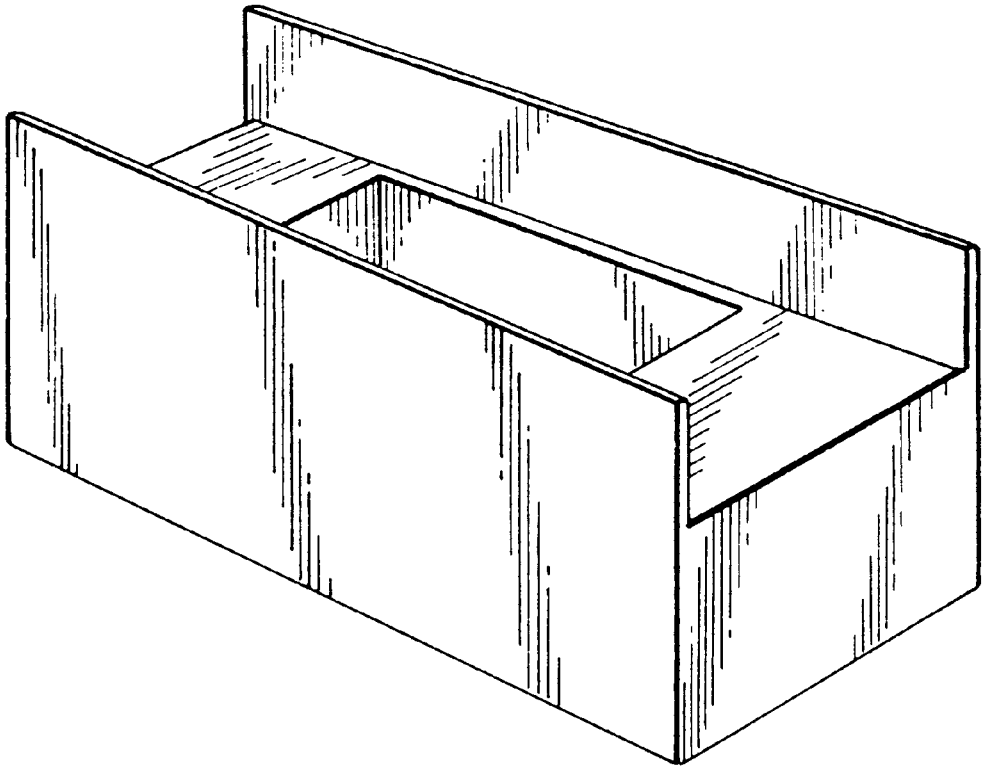
FIG. 18 is a perspective view of the refilling station.

FIG. 18 shows a perspective view of the refilling station which is used in connection with refilling the cartridge as described above, and as described in further detail below.

The present invention may be used for refilling reservoirs in a variety of ink-jet and bubble-jet type cartridges, including the Canon BC-01 cartridge, the Canon BC-02 cartridge, the Hewlett Packard HP 51626A high-capacity cartridge or the Hewlett Packard HP 51608A standard cartridge.

To refill the Canon-type cartridges, the following procedure is employed. The cartridge should be refilled when the ink in the reservoir is low, but before the cartridge dries out completely because residual ink may solidify and clog the printing mechanism. The cartridge is inserted into the refilling station so that the printed label and the rectangular slot face the person refilling the cartridge. Thereafter, the safety tip is removed from the pocket drill, and the drill is used to cut an opening into the cartridge at the top of the ink-cartridge. The dispensing-tip cover is then removed from the tip at the end of the dispensing extension, and the dispensing extension is inserted into the opening previously drilled. The dispensing container is then squeezed until ink bubbles out of the top of the cartridge. This step requires a gentle, but steady, pressure and may take up to five minutes depending upon the capacity of the cartridge reservoir, and how empty it is. After the cartridge reservoir is filled, excess ink is wiped off from the dispensing tip, at the top of the cartridge and the bottom of the cartridge, and the cartridge is replaced into the printer.

If there is remaining ink in the container, the dispensing tip cover may be placed over the tip, and the container may be stored for reuse.

For refilling the Hewlett Packard high-capacity ink-jet cartridges, the following procedure may be used. After the cartridge is removed from the printer, a supplied adhesive seal is placed over the release area at the bottom of the cartridge. The cartridge is then inserted into the refilling station so that the copper nozzles on the ink-jet cartridge face away from the person refilling the cartridge. A pointed instrument, such as a ballpoint pen or pencil or similar instrument, may then be used to create an opening by pushing a plastic plug which can be found in a corner of the cartridge top into the cartridge. The plastic plug is pushed completely through so that it falls into the reservoir of the cartridge and is left there. This plug will not interfere with the proper working of the cartridge during printing. Thereafter, the tip cover is removed from the tip, and the dispensing extension is inserted into the opening. The container is then squeezed gently until ink bubbles to the top of the cartridge. Again, gentle pressure is used, and it may take up to five minutes to refill the cartridge reservoir depending upon the capacity of the cartridge and how empty it is. After the refilling procedure is complete, the excess ink is wiped off from the dispensing tip, the top of the cartridge and the bottom of the cartridge.

The replacement plug is then removed from the lanyard attached to the closure and is placed into the opening on the ink-jet cartridge to reseal the ink-jet cartridge. The priming pump is then placed over a vent hole of the ink-jet cartridge and is depressed once or twice until a small amount of ink bleeds from the bottom of the cartridge. This equalizes the pressure within the reservoir and prepares the cartridge for printing.

To refill the Hewlett Packard standard cartridges, the following procedure may be used. After the cartridge is removed from the printer, it is placed into the refilling station so that the copper nozzles and green arrow on top of the cartridge are facing away from the person refilling the cartridge. Once the opening is located at the center of the green top of the cartridge, the dispensing tip is inserted into the opening and the bottle is squeezed gently until ink bubbles to the top of the cartridge. Once again, gentle, but steady, pressure is required on the bottle until a few drops of the ink drop out of the bottom of the cartridge. This step may take up to five minutes depending on the capacity of the cartridge, and how empty it is. After the cartridge is refilled, the excess ink is wiped off from the dispensing tip, the top of the cartridge and the bottom of the cartridge with a tissue. The cartridge is then replaced into the printer.

I claim:

1. A thermoplastic closure for a fluid container, the closure comprising:

a base having (i) a threaded section for engaging a threaded neck of a container, (ii) a bottom portion which abuts the container in a peripheral area where the neck meets the container, (iii) an internal upper portion which extends into a dispensing extension, and (iv) a tapered rim located within the internal upper portion of the base having a bottom minimum diameter that is less than the diameter of the interior of the neck and an upper maximum diameter that is greater than the diameter of the neck so that the rim frictionally engages the interior of the neck when the closure is connected to the container to create a seal between the closure and the container;

said dispensing extension continuous with and extending from the base and ending at a tip, said extension including a flexible, cylindrical, needle-like portion, said extension having an internal cylindrical cavity of a substantially constant diameter with an interior aperture positioned within the base and an exterior aperture positioned at the tip; and a tip cover removably attached to the tip.

2. A thermoplastic closure according to claim 1 wherein the tip cover is coextensive with a lanyard which is attached to the base and which is sufficiently long so that the tip cover may be placed over the tip.

3. A thermoplastic closure according to claim 2 further comprising a replacement plug removably attached to the lanyard.

4. A thermoplastic closure according to claim 3, further comprising locking means to lock the closure to the container and create a tamperproof connection between the closure and the container.

5. A thermoplastic closure according to claim 4, for a container which has a plurality of lugs located in the peripheral area where the neck meets the container, and the locking means comprises:

a plurality of wings corresponding to the number of lugs located on the container and positioned on the circumference of the bottom portion of the base so that when the closure and connected to the container the wings engage and lock into the lugs and create and tamperproof connection.

* * * * *